US009215958B2

(12) United States Patent
Vanderlinden

(10) Patent No.: US 9,215,958 B2
(45) Date of Patent: Dec. 22, 2015

(54) PICK-UP HEAD SYSTEM

(76) Inventor: Roger P. Vanderlinden, Burlington (CA)

( * ) Notice: Subject to any disclaimer, the term of this patent is extended or adjusted under 35 U.S.C. 154(b) by 862 days.

(21) Appl. No.: 13/495,870

(22) Filed: Jun. 13, 2012

(65) Prior Publication Data

US 2013/0019431 A1 Jan. 24, 2013

Related U.S. Application Data

(60) Provisional application No. 61/496,410, filed on Jun. 13, 2011.

(51) Int. Cl.

| | |
|---|---|
| ***E01H 1/08*** | (2006.01) |
| ***A47L 9/02*** | (2006.01) |
| ***A47L 11/40*** | (2006.01) |

(52) U.S. Cl.

CPC ..... *A47L 9/02* (2013.01); *A47L 11/4044* (2013.01); *E01H 1/08* (2013.01); *E01H 1/0827* (2013.01); *E01H 1/0836* (2013.01); *E01H 1/0845* (2013.01); *E01H 1/0872* (2013.01)

(58) Field of Classification Search

CPC ..... A47L 5/365; A47L 9/22; A47L 9/2821; A47L 11/4044; A47L 9/02; E01H 1/08; E01H 1/0827; E01H 1/0836; E01H 1/0872; E01H 1/0845

USPC ..... 15/319, 339, 346, 419, 340.1, 340.3

IPC ..... E01H 1/08

See application file for complete search history.

(56) References Cited

U.S. PATENT DOCUMENTS

| | | | | | |
|---|---|---|---|---|---|
| 3,669,145 | A | * | 6/1972 | Holstrom | 137/565.33 |
| 3,778,864 | A | * | 12/1973 | Scherer | 15/339 |
| 3,886,623 | A | * | 6/1975 | Landesman et al. | 15/319 |
| 4,555,826 | A | * | 12/1985 | Rodgers et al. | 15/340.3 |
| 4,991,253 | A | * | 2/1991 | Rechsteiner | 15/301 |
| 5,363,533 | A | * | 11/1994 | Young et al. | 15/339 |

* cited by examiner

*Primary Examiner* — David Redding

(57) ABSTRACT

A pick-up head system comprises a housing and a main fan connected in air suctioning relation to the housing for causing the interior of the housing to have a reduced internal air pressure. A secondary substantially continuously available source of low air pressure has an inlet connected in air suctioning relation to the housing. A valve is operatively mounted between the housing and the inlet of the source of low air pressure. A control mechanism is operatively connected to the valve and responsive to at least one operational condition in the pick-up head system. In a reduced-flow position, the air pressure in the housing is unaffected by the vacuum tank. In the increased-flow position, when the at least one operational condition passes a threshold, the vacuum tank decreases the air pressure in the housing, thus precluding the escape of dust and other fine particulate matter from the interior of the housing.

5 Claims, 3 Drawing Sheets

PICK-UP HEAD SYSTEM

RELATED APPLICATIONS

This application is a non-provisional application claiming priority from U.S. Provisional Patent Application Ser. No. 61/496,410 filed on Jun. 13, 2011, which is herein incorporated by reference.

FIELD OF THE INVENTION

The present invention relates to pick-up head systems for factory, sidewalk and street sweepers, and more particularly to such dustless pick-up at systems that readily maintain suctioning effectiveness under almost all conditions.

BACKGROUND OF THE INVENTION

Most prior art surface cleaning vehicles, such as factory floor sweepers, sidewalk sweepers, and street sweepers, use a debris pick-up head of one sort or another to engage a surface to be cleaned as the surface cleaning vehicle travels along. In order to preclude the escape of dust and other fine particulate matter from the debris pick-up head during use, air is suctioned from the debris pick-up head by the main fan of the vehicle. The debris pick-up head engages the ground in a semi-sealed relation in order to preclude the escape of dust and other fine particulate matter from between the debris pick-up head and the surface to be cleaned.

One very significant problem with such a system is that as the debris pick-up head traverses over the surface to be cleaned, it often encounters significant unevenness in the surface to be cleaned, such a potholes, speed bumps, and the like. In this case, at least a portion of the bottom edge of the debris pick-up head becomes temporarily separated from the surface to be cleaned. Accordingly, the dust and other fine particulate matter are thereby potentially allowed to escape from between the debris pick-up head and the surface to be cleaned, due to the loss of reduced air pressure within the pick-up head.

One solution to this problem is to increase the speed of the main fan, thereby increasing the suction of air from the debris pick-up head. It is well known that this solution does not work effectively because the main fan cannot be sped up quickly enough to apply significantly increased suction to the debris pick-up head while the separation exists between the debris pick-up head and the surface to be cleaned as the vehicle continues to travel.

In order to work effectively and solve the problem of debris escaping between the debris pick-up head and the surface to be cleaned, the increased suction of air from the debris pick-up head must be available virtually immediately once there is a separation between the debris pick-up head and the surface to be cleaned.

It is an object of the present invention to provide a dustless debris pick-up head system.

It is an object of the present invention to provide a debris pick-up head system wherein increased suction of air from the debris pick-up head is available virtually immediately once there is a separation between the debris pick-up head and the surface to be cleaned.

SUMMARY OF THE INVENTION

In accordance with one aspect of the present invention there is disclosed a novel dustless pick-up head system for use with a surface cleaning vehicle. The dustless pick-up head system comprises a main housing having a surface engaging portion and a substantially hollow interior; a main fan having an inlet connected in air suctioning relation to the substantially hollow interior of the main housing and an outlet connected in air delivering relation to the substantially hollow interior of the main housing, for re-circulating high speed air through the main housing; a secondary substantially continuously available source of low air pressure having an inlet connected in air suctioning relation to the substantially hollow interior of the main housing; a valve operatively mounted between said substantially hollow interior of said main housing and the inlet of said secondary substantially continuously available source of low air pressure, wherein said valve is selectively movable between a reduced-flow position and an increased-flow position; and a control mechanism operatively connected to the valve and responsive to at least one operational condition in the dustless pick-up head system, for moving the valve between the reduced-flow position and the increased-flow position when the at least one operational condition passes a threshold, thereby decreasing the air pressure in the substantially hollow interior of the main housing, thus precluding the escape of dust and other fine particulate matter from the substantially hollow interior of the main housing.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

BRIEF DESCRIPTION OF THE DRAWINGS

The novel features which are believed to be characteristic of the pick-up head system according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawing.

DETAILED DESCRIPTION OF THE PREFERRED EMBODIMENT

Figure 1:
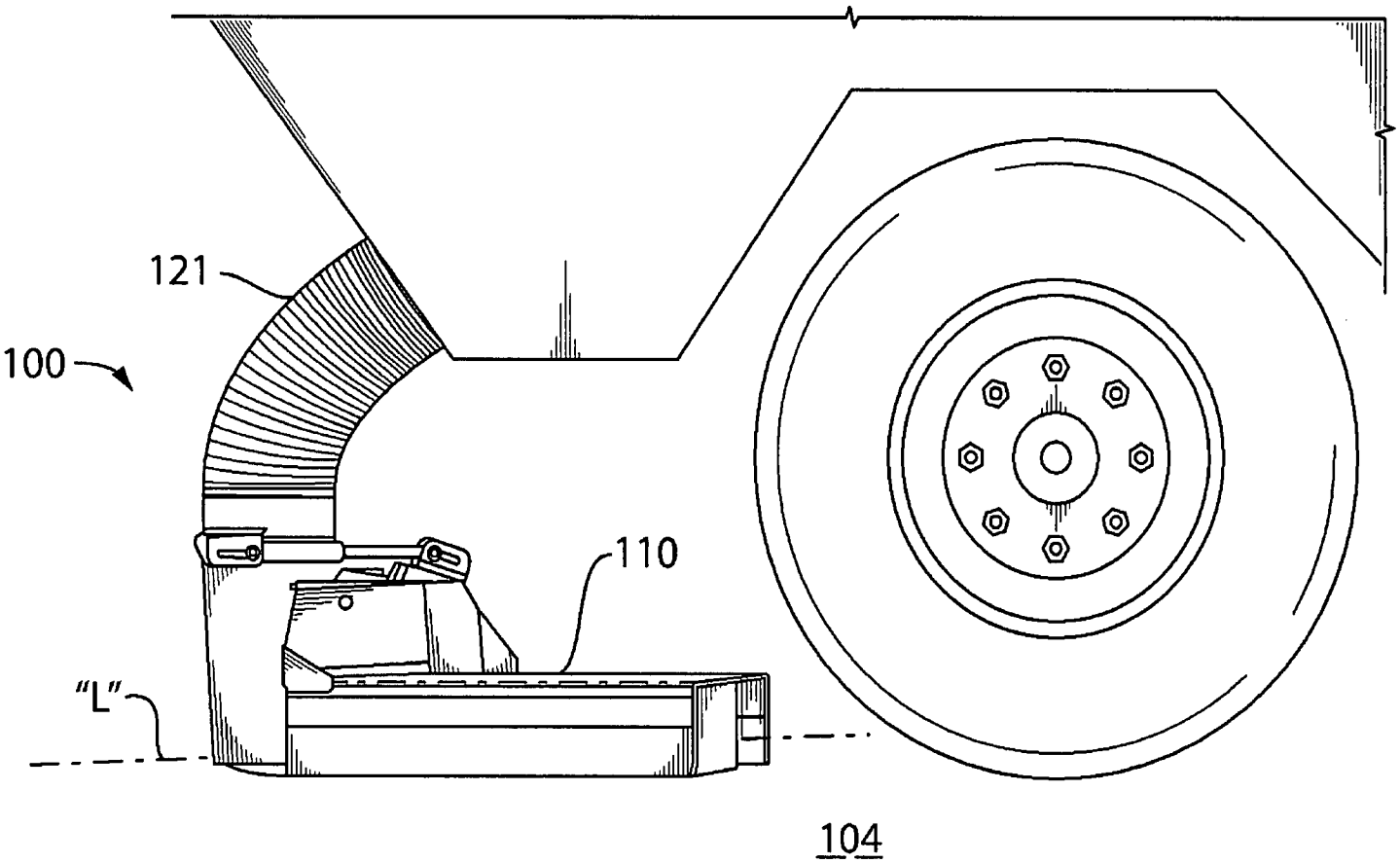
FIG. 1 is a side elevational view of the preferred embodiment of the pick-up head system according to the present invention mounted on a surface cleaning vehicle.
Figure 2:
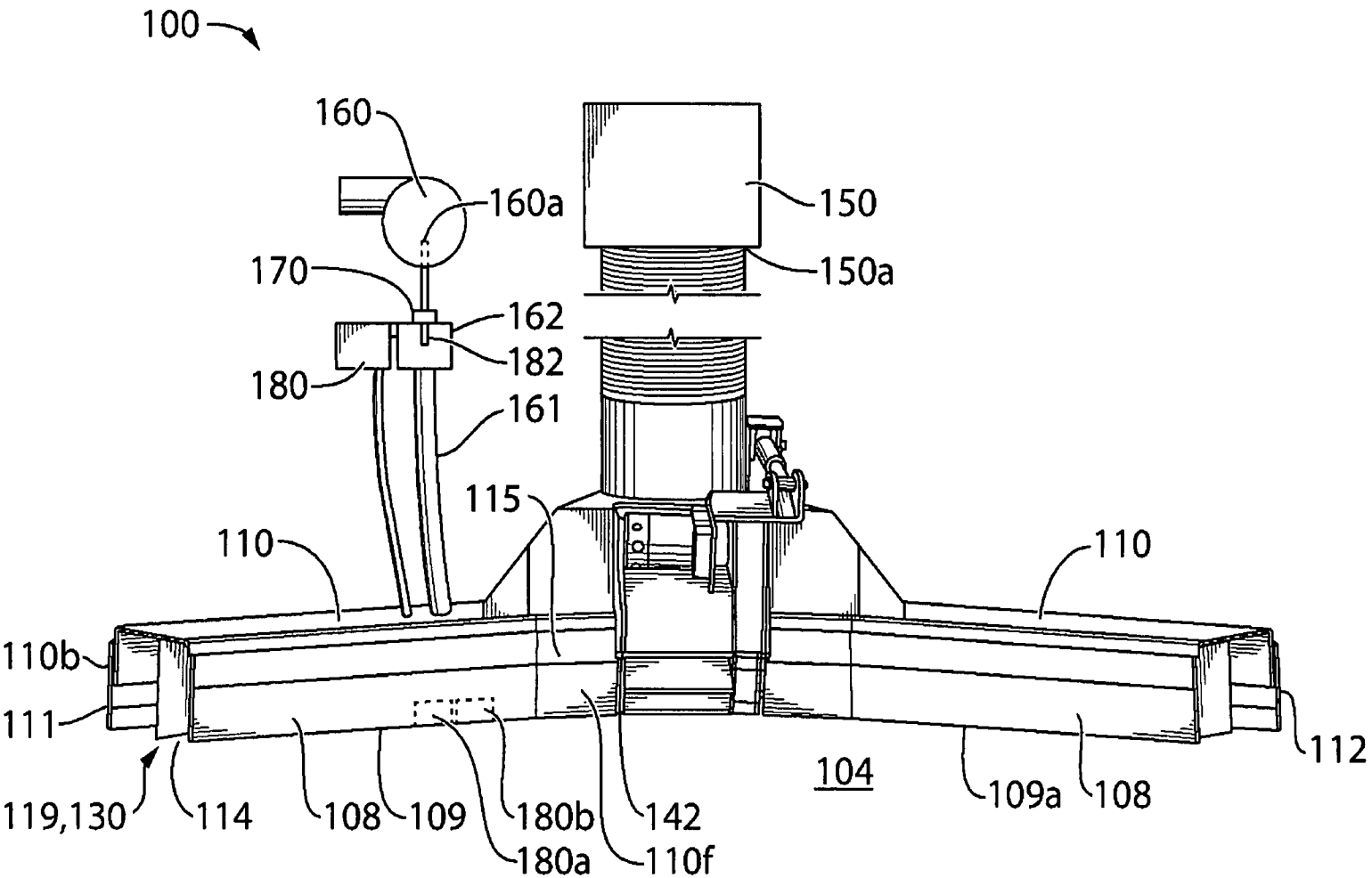
FIG. 2 is a perspective view of the preferred embodiment of the pick-up head system of FIG. 1.

Reference will now be made to FIGS. 1 through 3A, which show a preferred embodiment of the pick-up head system of the present invention, as indicated by general reference numeral 100. The dustless pick-up head system 100 is for use with a surface cleaning vehicle 102 for removing dust (including fine particulate matter) and debris (including bottles, cans, leaves, dirt, and so on) from a surface to be cleaned 104.

The dustless pick-up head system 100 comprises a main housing 110 extending between a front 110*f*, a back 110*b*, a first end 111 and a second end 112, and having a suctioning bottom opening 114 defined by a bottom peripheral edge 109.

The main housing 110 has a surface engaging portion 109*a* at the bottom peripheral edge 109 and a substantially hollow interior 119 that includes a debris passage 130. The suctioning bottom opening 114 is defined by the bottom peripheral edge 109 and leads to the substantially hollow interior 119.

The housing 110 further comprises a substantially rigid skirt 108 is disposed at the bottom peripheral edge 109 of the housing 110 for interfacing the housing 110 in substantially sealed relation with the surface to be cleaned 104 as the surface cleaning vehicle 102 moves along the surface to be cleaned 104. The substantially rigid skirt 108 is for interfacing the housing 110 in substantially sealed relation with the surface to be cleaned 104 as the surface cleaning vehicle moves along the surface to be cleaned 104. The substantially rigid skirt 108 precludes the passage of almost all air (and contaminants therein, such as dust and other fine particulate matter and the like) from escaping out of the housing 110 in the event that a section of the housing 110 has a higher air pressure than the ambient surroundings, which can occur with recirculating air type pick-up head systems, if the seal with the surface to be cleaned 104 is not present. A very small portion of air is suctioned between the substantially rigid skirt 108 and the surface to be cleaned 104 to preclude any dust and other fine particulate matter and the like from escaping from the housing 110, and also to suction in dust and other fine particulate matter and the like under the substantially rigid skirt 108 at the front wall portion 115 of the housing 110, which may be created as the substantially rigid skirt 108 at the front wall portion 115 engages the surface to be cleaned 104.

Furthermore, the substantially rigid skirt 108 precludes the passage of larger debris, such as stones, bottles, cans, leaves, and the like, from passing under the front wall portion 115 of the housing 110 and moves along the surface to be cleaned 104. Instead, the front wall portion 115 and the substantially rigid skirt 108 direct such larger debris to the debris receiving front inlet 142 due to the "V" shape of the housing 110.

A main fan 150 is connected at its inlet 150*a* in air suctioning relation to the substantially hollow interior 119 of the main housing 110 and an outlet 150*b* connected in air delivering relation to the substantially hollow interior 119 of the main housing 110, for re-circulating high speed air through the main housing 110, to remove dust and debris from the main housing 110 and also to impact the surface being cleaned 104.

There is also a secondary substantially continuously available source of low air pressure 160 having an inlet connected in air suctioning relation to the substantially hollow interior 119 of the main housing 110 via a conduit 161. In the preferred embodiment, as illustrated, the secondary substantially continuously available source of low air pressure 160 comprises a secondary fan 160 having an inlet 160a. The secondary fan 160 is preferably a multi-stage centrifugal fan, or the like, in order to produce significant negative pressure. As can be readily discerned by one skilled in the art, the secondary fan 160 is operated on a continuous basis, in order to have a source of low air pressure available at any time. The speed of the secondary fan 160 is preferably controllable in order to permit selection of an ideal level of low air pressure.

It should be understood that in order for the system to work properly, the inlet 160*a* of the secondary fan 160 should be at or below the reduced pressure of the inlet 150*a* of the main fan 150 so that the main fan 150 will not cause air to be drawn in a reverse direction through the secondary fan 160.

The secondary fan 160 is connected at its inlet 160a in air suctioning relation to the substantially hollow interior 119 of the main housing 110 via the valve 170, when the valve 170 is open. When the valve is closed, the secondary fan 160 merely draws against dead air space between the inlet 160*a* of the secondary fan 160 and the valve 170. In an alternative embodiment, it is contemplated that the valve could be a pressure regulating diverter valve that draws against open air when the diverter valve is in its reduced-flow position.

Also, it is contemplated that the secondary substantially continuously available source of low air pressure 160 could be a vacuum tank that has air removed from its hollow interior by a suitable vacuum pump (not specifically shown).

The present invention further comprises an air filter 162 connected in air filtering relation between the main housing 110 and the secondary substantially continuously available source of low air pressure 160.

Figure 3A:
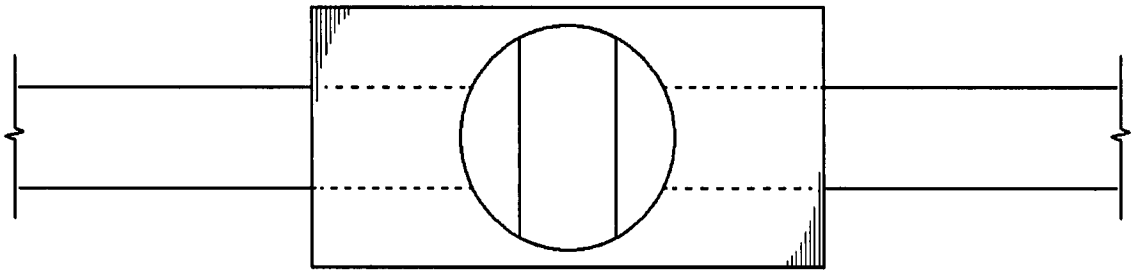
FIGS. 3*a*, 3B, are a view of the position of the valve in an open and closed position.
Figure 3B:
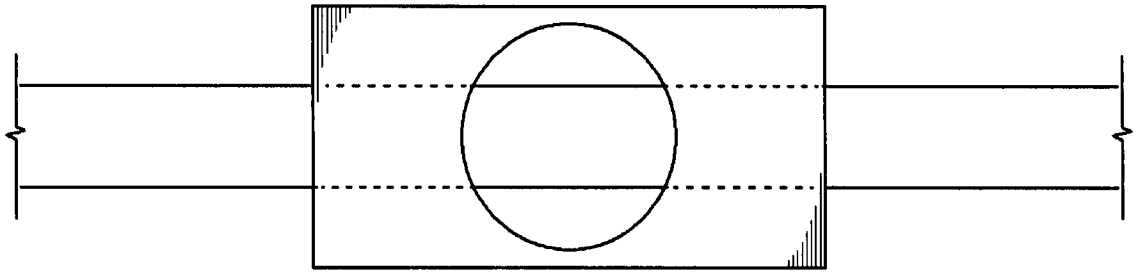

A valve 170 is operatively mounted between the substantially hollow interior 119 of the main housing 110 and the inlet 160*a* of the secondary substantially continuously available source of low air pressure 160. The valve 170 is selectively movable between a reduced-flow position, as is shown in FIG. 3A, and an increased-flow position, as is shown in FIG. 3B. In the preferred embodiment, as illustrated, when the valve 170 is in the reduced-flow position, the valve 170 is actually closed. In other words, the valve 170 completely closes off the fluid communication between the substantially hollow interior 119 of the main housing 110 and the inlet 160a of the secondary substantially continuously available source of low air pressure 160. Accordingly, the secondary substantially continuously available source of low air pressure 160, namely the secondary fan 160, would be suctioning against dead air space. The low pressure within the housing 110, as compared to the ambient surroundings, would be caused solely by the main fan 150. Alternatively, it is contemplated that in the reduced-flow position, the valve 170 is partially open. In this case, the secondary fan 160 assists the main fan 150 to reduce the pressure within the housing 110.

In complete contrast, in the increased-flow position of the valve 170, the substantially hollow interior 119 of the main housing 110 and the inlet 160*a* of the secondary substantially continuously available source of low air pressure 160, namely the secondary fan 160, are in substantially increased fluid communication one with the other, and potentially in full fluid communication one with the other, to thereby permit the secondary fan 160 to immediately forcefully suction air from the substantially hollow interior 119 of the main housing 110. Accordingly, the air pressure within the main housing 110 remains reduced with respect to the ambient surroundings, and no dust and other fine particulate matter are expelled from the main housing 110.

A control mechanism 180 is operatively connected to the valve 170 and responsive to at least one operational condition in the dustless pick-up head system 100, for moving the valve 170 between the reduced-flow position and the increased-flow position when the at least one operational condition passes a threshold, thereby decreasing the air pressure in the substantially hollow interior 119 of the main housing 110, thus precluding the escape of dust and other fine particulate matter from the substantially hollow interior 119 of the main housing 110. The control mechanism 180 comprises at least one air pressure sensor 180*a* and is responsive to changes in air pressure in the surface cleaning apparatus. The threshold pressure would be below ambient air pressure and above the normal operating reduced air pressure within the substantially hollow interior 119 of the main housing 110. Typically, a plurality of air pressure sensors 180*a* (only one shown) would be used throughout the housing 110, in order to readily sense a reduction in air pressure anywhere around the bottom peripheral edge 109 of the housing 110.

The control mechanism 180 further comprises at least one air flow sensor 180*b* that is responsive to change in air flow speed of air within the main housing 110. Typically, a plurality of air flow sensors 180*b* (only one shown) would be used. Each air flow sensor 180*b* would preferably be disposed adjacent the bottom peripheral edge 109 of the main housing 110, and is responsive to change in air flow speed in the main housing 110. Accordingly, the air flow sensors 180*b* together could readily sense air flow anywhere around the bottom peripheral edge 109 of the main housing 110.

In order to actually move the valve 170 between its increased-flow position and its reduced-flow position, the control mechanism 180 further comprises an air cylinder 182 operatively mounted between a solid foundation such as the body of the secondary fan 160 and the valve 170.

It is also contemplated that the control mechanism 180 can monitor the air pressure within the main housing 110 and can move the valve 170 to any position to thereby regulate the amount of air suctioned from the main housing 110, thus permitting a desired level of reduced air pressure in the main housing 110 to be maintained.

In use, when the surface cleaning vehicle 102 is travelling along a surface to be cleaned 104, it is common to encounter a situation wherein at least a portion of the surface engaging portion 109*a* of the bottom peripheral edge 109 of the housing 110 becomes temporarily separated from the surface to be cleaned 104. In this case, the air pressure within the housing increases to ambient air pressure, or nearly ambient air pressure, which is sensed by the air pressure sensors 180*a*. Furthermore, the overall air flow into the main housing 110 increases, which is sensed by the air flow sensors 180*b*. Accordingly, upon receiving a signal from either of the sensors 180*a* and 180*b*, the control mechanism 180 would cause the valve 170, which is in its reduced-flow position, to move to its increased-flow position, thereby permitting the secondary substantially continuously available source of low air pressure 160, namely the secondary fan 160, to immediately suction air from the housing 110. In this manner, the air pressure within the substantially hollow interior 119 of the housing 110 remains lower than the ambient air pressure around the housing 110, and dust and other fine particulate matter, and the like, are not expelled from the housing 110.

It should be understood that without the dustless pick-up head system 100 according to the present invention, when a significant separation occurs between the bottom peripheral edge 109 and the surface to be cleaned 104, the normally reduced air pressure within the substantially hollow interior 119 of the housing 110 is quickly increased to a level where air is no longer being suctioned into the substantially hollow interior 119 of the housing 110, and dust and other fine particulate matter, and the like, can readily be expelled from the housing 110, which is unacceptable. Such expulsion is made significantly worse, if the dustless pick-up head system 100 is a re-circulating type of pick-up head system with a high-speed and/or high volume stream of air being delivered into the housing 110.

As can be understood from the above description and from the accompanying drawings, the present invention provides a dustless debris pick-up head system wherein increased suction of air from the debris pick-up head is available virtually immediately once there is a separation between the debris pick-up head and the surface to be cleaned, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the dustless pick-up head system of the present invention without departing from the spirit and scope of the accompanying claims.

I claim:

1. A dustless pick-up head system for use with a surface cleaning vehicle, said dustless pick-up head system comprising:

a main housing having a surface engaging portion and a substantially hollow interior;

a main fan having an inlet connected in air suctioning relation to said substantially hollow interior of said main housing and an outlet connected in air delivering relation to said substantially hollow interior of said main housing, for re-circulating high speed air through said main housing;

a secondary substantially continuously available source of low air pressure having an inlet connected in air suctioning relation to said substantially hollow interior of said main housing;

a valve operatively mounted between said substantially hollow interior of said main housing and the inlet of said secondary substantially continuously available source of low air pressure, wherein said valve is selectively movable between a reduced-flow position and an increased-flow position; and, a control mechanism operatively connected to said valve and responsive to at least one operational condition in said dustless pick-up head system, for moving said valve between said reduced-flow position and said increased-flow position when said at least one operational condition passes a threshold, thereby decreasing the air pressure in said substantially hollow interior of said main housing, thus precluding the escape of dust and other fine particulate matter from said substantially hollow interior of said main housing.

2. The dustless pick-up head system of claim 1, wherein said secondary substantially continuously available source of low air pressure comprises a secondary fan.

3. The dustless pick-up head system of claim 1, wherein said control mechanism comprises at least one air pressure sensor and is responsive to changes in air pressure in said surface cleaning apparatus.

4. The dustless pick-up head system of claim 1, wherein said control mechanism comprises at least one air flow sensor and is responsive to change in air flow in said housing.

5. The dustless pick-up head system of claim 1, wherein said control mechanism is responsive to change in air flow speed in said housing.

* * * * *